United States Patent [19]

Bruno

[11] 4,162,553

[45] Jul. 31, 1979

[54] TOOTH CLEANER

[76] Inventor: Patrick J. Bruno, 6, Anderson Dr., Albany, N.Y. 12205

[21] Appl. No.: 864,717

[22] Filed: Dec. 27, 1977

[51] Int. Cl.[2] ..... A46B 1/00

[52] U.S. Cl. ..... 15/167 R; 15/227; 24/206 R

[58] Field of Search ..... 15/167 R, 227, 110; 24/16 PB, 73 AP, 73 PB, 206 A, 208 A

[56] References Cited

U.S. PATENT DOCUMENTS 2,979,794 4/1961 Bartolo ..... 24/206 A X 3,798,698 3/1974 Conklin, Jr. ..... 15/167 R

*Primary Examiner*—Peter Feldman

[57] ABSTRACT

A disposable tooth cleaner of the type that includes integrally formed fastening means for attaching the device to a user's finger in the form of two oppositely extending strip portions one of which is provided with a longitudinally extending opening and the other of which is provided with a tongue insertable into said opening into latched engagement therewith at various positions of adjustment when the strip portions are wrapped around the user's finger.

1 Claim, 6 Drawing Figures

TOOTH CLEANER

BACKGROUND OF THE INVENTION

This invention relates to disposable tooth cleaners, and more particularly to a device of this character which includes improved means for securing the tooth cleaner to the finger of the user. This invention constitutes an improvement of disposable tooth cleaners of the type disclosed in U.S. Pat. No. 3,798,698.

SUMMARY OF THE INVENTION

In general, as one aspect of the present invention the tooth cleaner comprises novel integrally formed fastening means for attaching the device to a user's finger in the form of two oppositely extending strip portions one of which is provided with a longitudinally extending opening that includes an inner wall protrusion and the other of which is provided with a tongue including longitudinally spaced upstanding protrusions insertable into said opening into latched engagement therewith at various positions of adjustment when the strip portions are wrapped around the user's finger.

As another aspect of the present invention the tooth cleaner of the present invention is uniquely designed and adapted to consist of integrally formed component portions of synthetic resinous material that can be molded as a unit, thereby providing unusual economics in material and fabrication costs.

It is, therefore, a primary object of the present invention to provide a disposable tooth cleaner that includes a novel integrally formed fastening means for securing the device to a user's fingers at various positions of adjustment.

It is another object of the present invention to provide an improved disposable tooth cleaner the components of which are uniquely adapted to be integrally molded as an integral unit thereby eliminating expensive assembly costs during fabrication of the devices.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
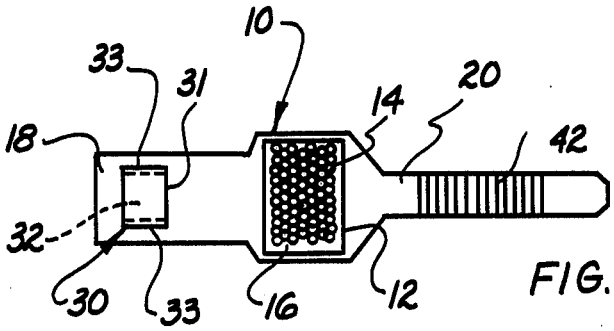
FIG. 1 is a top elevational view of the disposable tooth cleaner of the present invention.
Figure 3:
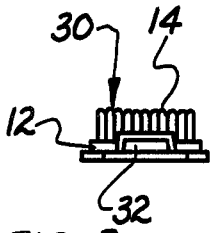
FIG. 3 is an end view of the disposable tooth cleaner of the present invention.
Figure 2:
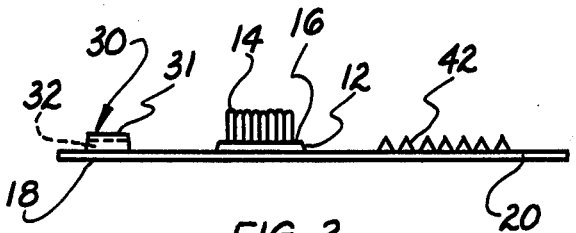
FIG. 2 is a side elevational view of the disposable tooth cleaner of the present invention.
Figure 4:
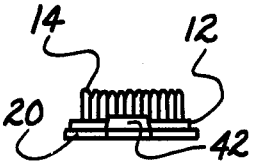
FIG. 4 is another end view of the disposable tooth cleaner of the present invention.
Figure 5:
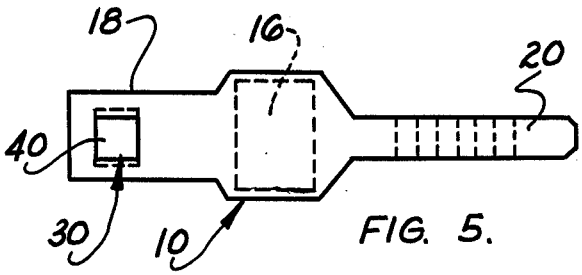
FIG. 5 is a bottom view of the disposable tooth cleaner of the present invention.

Referring in detail to the drawings, the disposable tooth cleaner of the present invention comprises a body portion 10 formed of integrally molded components of synthetic resinous material such as ethylvinylacetate or the like, which assembly includes a central platform portion 12, spaced projections 14 extending upwardly from an upper surface 16 of said platform portion, and outwardly extending strip portions 18 and 20.

Figure 6:
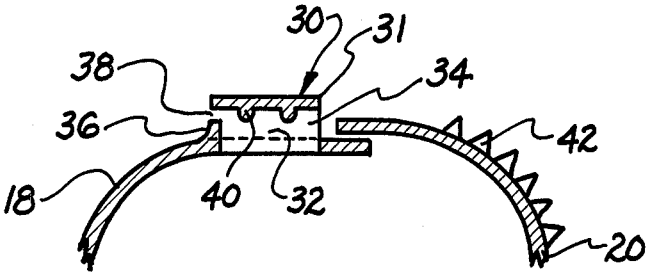
FIG. 6 is an enlarged partial view of an integrally formed fastening means comprising a portion of the tooth cleaner of the preceding figures.

Reference is next made to FIG. 6 which illustrates in detail the improved fastening means indicated generally at 30 of the present invention which includes a longitudinally extending passage 32 provided with an entrance aperture 34, inner wall protrusions 40, top wall 31, and upstanding guide 36, the latter forming a restricted end aperture 38.

With continued reference to FIG. 6, the other strip portion 20 is in the form of a tongue provided with a plurality of longitudinally spaced upstanding tongue protrusions or teeth 42.

It will now be understood that when the device is wrapped around the user's finger the tongue-shaped tip of fastener portion 20 is inserted into aperture 34 of longitudinally extending passage 32 and thence outwardly through restricted end aperture 38. The tongue is next extended further through passage 32 until the device fits snugly around the finger with the teeth 42 in latched engagement with inner wall protrusions 40 wherein the tooth cleaner is firmly secured to the finger with the proper size adjustment for maintaining it in position.

While the form of embodiment herein shown and described, constitutes a preferred form, it is to be understood that other forms may be adopted falling within the scope of the claims that follow.

What is claimed is:

1. A disposable toothbrush comprising a molded one piece integrally formed elongated strip of plastic material including a centrally disposed base portion having a plurality of bristles emanating from the surface thereof, said base portion being thicker than the strip and adding rigidity thereto and serving as a strong junction between the bristles and the strip for maintaining the bristles in an upstanding orientation during the cleaning operation, a first strip portion and a second strip portion extending outwardly from opposite sides of said base portion, respectively, said first strip portion including an integrally formed fastener portion forming a longitudinally extending passage including an inner wall provided with an inner wall protrusion, said second strip portion including a second integrally formed fastener portion comprising a longitudinally extending tongue provided with a plurality of longitudinally spaced upstanding tongue protrusions adapted to be forced into latched engagement with said inner wall protrusion at various positions of adjustment for securing said toothbrush to a finger of a user, wherein said longitudinally extending opening includes a restricted end aperture forming a guide for urging said upstanding tongue protrusions into latched engagement with said inner wall protrusion and an unrestricted entrance aperture that permits easy one-handed insertion of the tongue portion into and through the passage.

* * * * *